United States Patent [19]

Moritz

[11] Patent Number: 4,477,790

[45] Date of Patent: Oct. 16, 1984

[54] ELECTRICAL INDUCTIVE APPARATUS WITH COOLING CHANNELS

[75] Inventor: Bertil Moritz, Ludvika, Sweden

[73] Assignee: Asea Aktiebolag, Västerås, Sweden

[21] Appl. No.: 351,255

[22] Filed: Feb. 22, 1982

[30] Foreign Application Priority Data

Feb. 24, 1981 [SE] Sweden ..... 8101197

[51] Int. Cl.[3] ..... H01F 27/08; H01F 27/28

[52] U.S. Cl. ..... 336/60; 29/602 R; 336/223; 336/225

[58] Field of Search ..... 336/60, 197, 185, 207, 336/205, 222, 223, 225, 228, 231, 206; 29/602 R

[56] References Cited

U.S. PATENT DOCUMENTS

| | | | |
|---|---|---|---|
| 3,056,071 | 9/1962 | Baker et al. | 336/60 X |
| 3,748,616 | 7/1973 | Weber et al. | 336/60 |
| 4,255,849 | 3/1981 | Beck et al. | 336/96 |
| 4,296,395 | 10/1981 | Moritz | 336/60 |
| 4,323,870 | 4/1982 | Moritz | 336/60 X |

FOREIGN PATENT DOCUMENTS

| | | | |
|---|---|---|---|
| 1948848 | 4/1971 | Fed. Rep. of Germany | 336/205 |
| 444809 | 7/1967 | Japan | 336/60 |
| 962222 | 7/1964 | United Kingdom | 336/197 |

*Primary Examiner*—Thomas J. Kozma
*Attorney, Agent, or Firm*—Watson, Cole, Grindle & Watson

[57] ABSTRACT

An electrical inductive apparatus, for example a transformer or a reactor, comprises a core and at least one winding wound around the core and formed of a plurality of superimposed turns of sheet-formed electrically-conducting material. The winding includes at least one element which, together with a surface of at least one of the turns of the winding, defines a plurality of channels for conducting an electrically-insulating fluid in contact with a part of said surface. These channels are defined between adjacent pairs of a plurality of connected together elongated spacing means of the element which are arranged in substantially parallel spaced relationship and which contact said surface. Each spacing means has a thickness which increases from a central region of the spacing means towards each of its opposite ends. This enables the turns of the winding to be flared out at their opposite ends in a suitable manner with respect to the electrical properties of the winding. The element may be manufactured from a sheet of insulating material by profile sawing in a processor-controlled sawing machine.

4 Claims, 7 Drawing Figures

FIG. 2
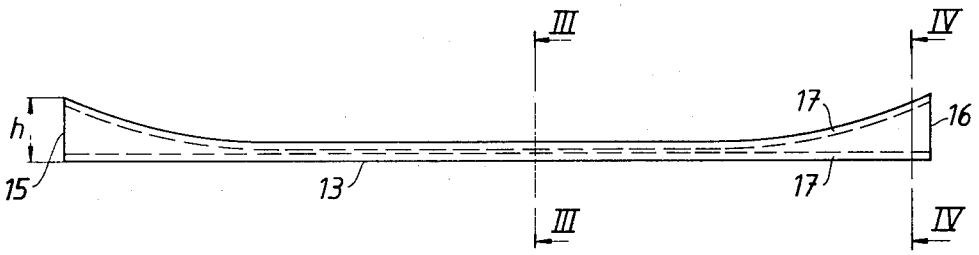
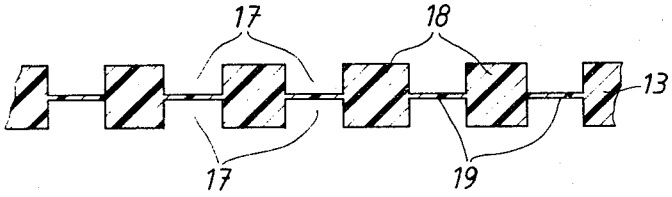
FIG. 3
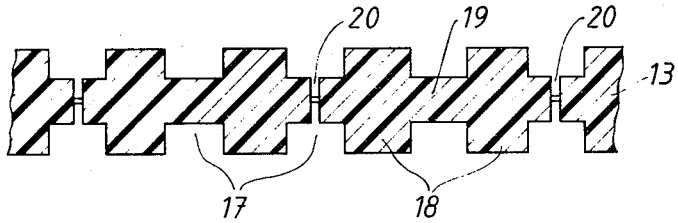
FIG. 4
FIG. 5
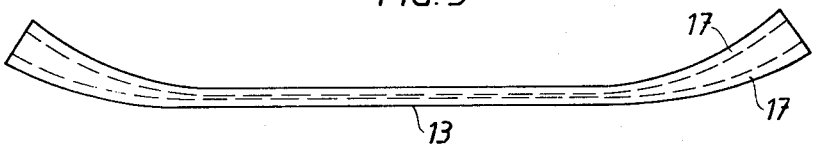

ELECTRICAL INDUCTIVE APPARATUS WITH COOLING CHANNELS

BACKGROUND OF THE INVENTION

1. Field of the Invention

This invention relates to an electrical inductive apparatus, for example a transformer or reactor, comprising a core and at least one winding wound on the core made from a plurality of superimposed turns of sheet-formed electrically-conducting material. The invention also relates to a method of, and machine for, making an element of the winding.

2. Description of Prior Art

In power transformers and reactors having windings formed from a plurality of turns of sheet-formed electrically-conducting material, a considerable displacement or concentration of the current may occur towards the edges of the turns, resulting in significant additional power loss as well as in considerable localized heating of the sheet at the edges of the turns. From U.S. patent application Ser. No. 176,918 filed in the names of Bertil Moritz et al on Aug. 11, 1980, now U.S. Pat. No. 4,323,870, and assigned with the present application to a common assignee, it is previously known to reduce the current displacement in the turns of the winding by forming the sheet so that the edge regions of at least some of the turns are located at a different distance from the geometrical axis of the winding compared with the distance from said axis of a central conductor portion in a respective one of said turns. The best result is obtained if the winding has a funnel-shaped deflection in the edge regions of at least some of its turns, the distance of the edge regions of such turns from the geometrical axis of the winding being greater than the distance of the central conductor portions of said turns from the geometrical axis of the winding. When using sheet-formed electrically-conducting material of even thickness for the winding turns, a filling material is thus required to bring about the desired funnel-like shape of the winding ends. For dielectric reasons, among other things, it is desirable for this filling to be of an electrically insulating material. Since such filling material has poor thermal conductivity, the filling should be located in thermal symmetry planes, that is, either in the middle of cooling channels passing axially through the winding or midway between two radially spaced-apart, axially extending cooling channels, so that the thermal conduction in the radial direction is not prevented. In the case of windings having cooling channel elements of an advantageous design consisting of a flexible sheet of insulating material having a plurality of grooves for fluid circulation formed in both of its sides (as described in European patent publication No. 40,382 with the present application to a common assignee) it is, however, difficult to arrange separate filling material near the cooling channels in the manner described above. On the whole, the insertion of separate filling presents problems with the location of the filling material, which requires great precision in position. Furthermore such insertion involves manual work resulting in low production rates.

The present invention aims to provide a solution to the above-mentioned problems by the provision in a winding of an electrical inductive apparatus of an element which acts both as a winding shaping member and as a cooling channel defining member.

SUMMARY OF THE INVENTION

According to the present invention an electrical inductive apparatus comprising a core and at least one winding wound on said core and comprising a plurality of superimposed turns of sheet-formed electrically-conducting material, and at least one element defining with a surface of at least one of said turns a plurality of channels for conducting an insulating fluid in contact with a part of said surface from one to the other end face of the winding, said at least one winding comprising a plurality of connected together, elongated spacing means disposed in substantially parallel spaced relationship in contact with the said surface, respective ones of said plurality of channels being formed between each connected together pair of said spacing means, wherein each of said elongated spacing means has a thickness, transverse to the direction of connection of the connected together spacing means, which increases from a central region of the spacing means towards each of its opposite ends.

The said element is suitably manufactured from an originally plane, rectangular, flexible sheet of insulating material, e.g. pressboard, which is profile-sawed on one of its sides in such a way that the sheet in regions along two opposed parallel side edges is given a thickness which increases in a direction towards said side edges and which corresponds to the thickness which is necessary to achieve a desired flared shape for the opposite end regions of the winding in the finished electrical inductive apparatus.

The sawing of the said elements is suitably carried out in a sawing machine with a plurality of saw blades of two different diameters, which are arranged alternately, coaxially next to each other, on a shaft, which is raisable and lowerable with respect to a supporting plane, on which the sheets for producing the elements are intended to be fed forward. The machine includes means for controlling the position, e.g. the vertical position, of the shaft relative to the supporting plane in dependence on the position of the respective sheet on the supporting plane. Suitably the control means includes processing means, e.g. a microprocessor. The profile of the said elements can be changed arbitrarily for each separate order. In this way, only the sequence of the said elements need be kept in mind during winding operations to attain the proper shape of the winding.

BRIEF DESCRIPTION OF THE DRAWINGS

The invention will now be described, by way of example, with particular reference to the accompanying drawings, in which:

FIG. 2 is a side view of a cooling channel element of the kind to be included in the transformer shown in FIG. 1 but prior to being softened at its edge portions, FIGS. 3 and 4 are sectional views of the cooling channel element shown in FIG. 2 and taken on the lines III—III and IV—IV, respectively, of FIG. 2, FIG. 5 is a side view of the cooling channel element shown in FIG. 2 after softening of the thicker edge portions of the element.

DESCRIPTION OF PREFERRED EMBODIMENTS

Figure 1:
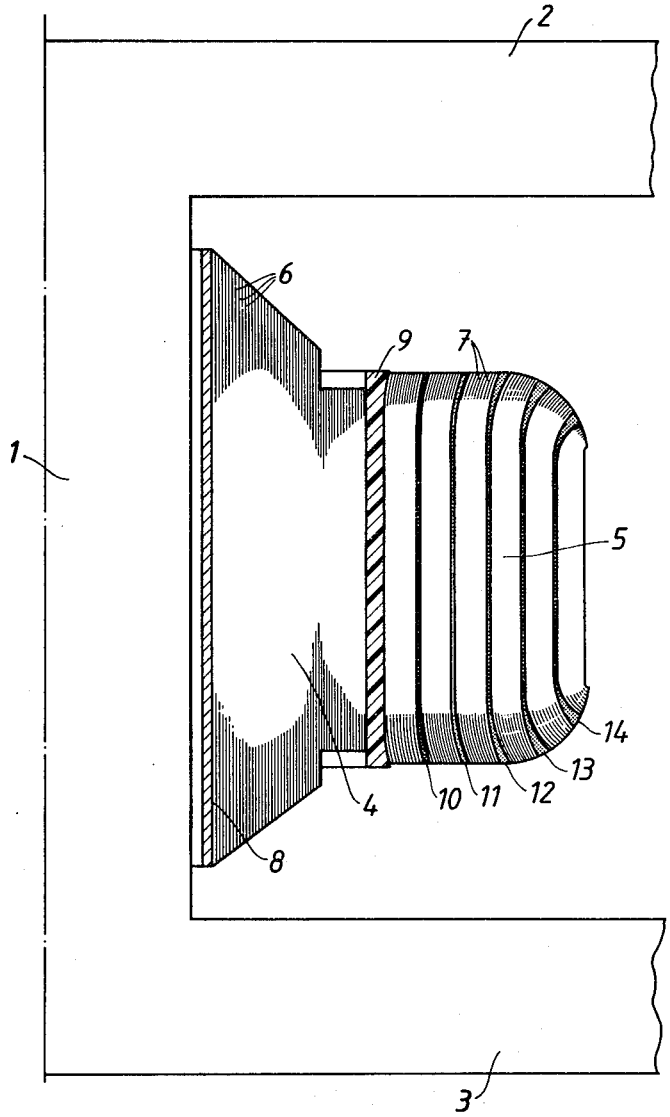
FIG. 1 is a schematic sectional view of part of a transformer constituting electrical inductive apparatus according to the invention.

FIG. 1 shows part of a magnetic core, comprising a core leg 1 and upper and lower yokes 2 and 3, respectively, of a power transformer. An inner winding 4 and an outer winding 5 are arranged concentrically around the core leg 1. The windings 4 and 5 are built up from turns 6 and 7, respectively, of a sheet of aluminium or copper foil, the thickness of which foil is from 0.01 mm to 3 mm, preferably from 0.02 mm to 1 mm. Between the turns of each winding 4, 5 there is a film of a suitable electrically insulating material, for example polyethyleneglycol terephthalate, the thickness of which may, for example, be from 0.01 mm to 0.1 mm. The inner winding 4 is wound onto a supporting cylinder 8 which surrounds the core leg 1 and which may be made, for example, of glass fiber reinforced polyester or a metallic material, typically aluminium. The outer winding 5 is in its turn wound around the inner winding 4 with an intermediate electrically insulating annular space between the windings 4 and 5, in which is arranged ribs 9 of electrically insulating material, for example pressboard, "Bakelite" ® or glass-fiber reinforced polyester, extending substantially parallel to the axis of the windings 4 and 5.

The magnetic core (e.g. laminated iron core) and windings 4, 5 of the tranformer are immersed in a transformer tank (not shown) filled with an electrically insulating fluid, for example transformer oil. In use of the transformer the windings 4, 5 are cooled by the insulating fluid flowing along cooling channels arranged in the windings, which cooling channels are formed from cooling channel elements arranged between adjacent turns of the conductor sheet at different radial distances from the geometrical axis of the windings. In FIG. 1 only the cooling channel elements 10 to 14 in the outer winding 5 are shown.

FIGS. 2 to 5 show the cooling channel element 13, the other cooling channel elements in the outer winding being similarly designed. The shown cooling channel element 13 is manufactured from a rectangular, originally plane sheet of pressboard having a thickness h of, for example, 8 mm, a width of, for example, 0.5 m, and a length which is at least as great as the width of the conductor foil, for example 2 m. One flat side of the pressboard sheet is profile-sawed in such a way that the sheet is given a thickness which increases towards its two transverse edge surfaces 15, 16. On both sides of the pressboard sheet there are cut spaced-apart, parallel grooves 17 designed to form cooling channels. The grooves 17 on either side of the pressboard sheet are positioned opposite to each other and extend from the transverse edge surface 15 to the transverse edge surface 16 of the sheet. The material remaining at the sides of the grooves 17 constitutes spaced-apart, parallel spacers 18, whereas the material remaining at the bottom of the grooves constitutes spaced-apart connecting pieces 19. To facilitate bending of the cooling channel element to facilitate construction of the winding, the thicker edge portions of the elements are fringed up by sawing through-going slots 20 into the ends of every second connecting piece 19. In addition, the edge portions are softened by being run through softening rolls (not shown) to enable the cooling channel element to be formed into the shape shown in FIG. 5.

As can be seen in FIG. 1, the later turns 7 of the outer winding 5 are shaped so that their edge regions are located at a greater distance from the geometrical axis of the winding 5 compared with the distance from the said axis of the respective center regions of those turns. This flaring or "funnel-shaping" of the edge portions of the turns 7 is particularly desirable since the edge regions of each turn 7 of the outer winding 5 are able substantially to follow the flux lines for the resultant magnetic leakage flux.

Figure 6:
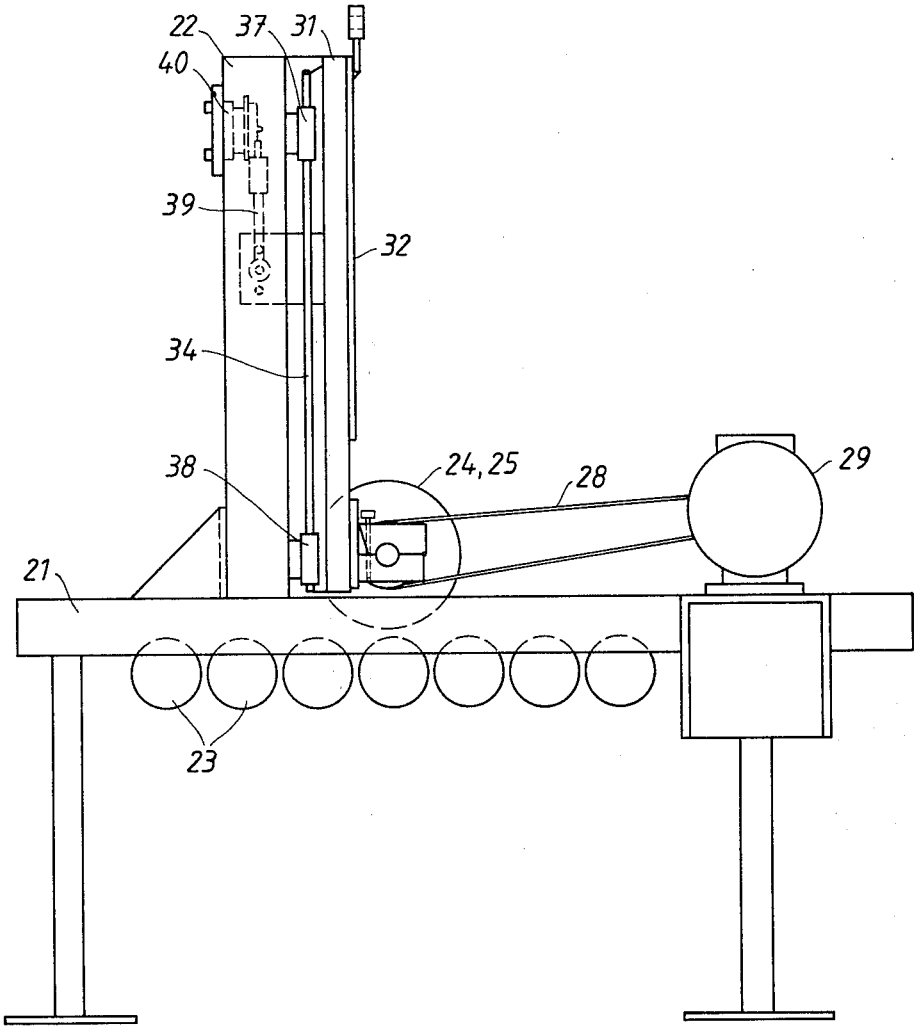
FIG. 6 is a side view of a sawing machine for sawing cooling channel elements of the kind shown in FIGS. 2 to 5.
Figure 7:
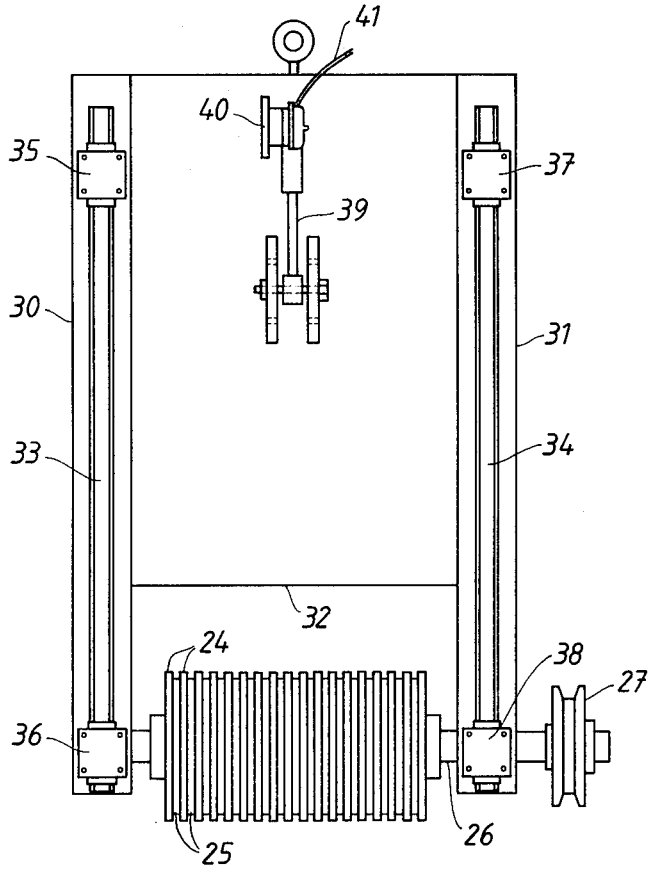
FIG. 7 is an end view of the upper part of the sawing maching shown in FIG. 6.

FIGS. 6 and 7 show schematically a sawing machine for forming cooling channel elements of the kind shown in FIGS. 2 to 5. The machine includes a stationary stand comprising a horizontal stand portion 21 and a vertical stand portion 22. In the horizontal stand portion 21 a number of supporting rollers 23 are journalled, the insulating sheets intended for the manufacture of the cooling channel elements being intended to be fed forward in a planar path on said supporting rollers during the sawing operation. The machine is provided with a large number of circular saw blades 24, 25 of two different diameters. The circular saw blades are clamped coaxially next to each other on a shaft 26, which is provided with a belt pulley 27 and is driven via a V-belt 28 from a motor 29. The circular saw blades are arranged alternately on the shaft 26 so that blades 24, 25 positioned adjacent each other have different diameters. The shaft 26 is journalled in a holder which is vertically displaceable on the vertical stand portion 22. This holder comprises two vertical beams 30, 31 and a plate 32 connecting the beams together. On one of their sides each of the beams 30, 31 supports a bearing for the shaft 26. On their other sides, each of the beams 30, 31 is provided with a round shaft 33 and 34, respectively, extending along, and being fixed to, the respective beam. These shafts 33, 34 are journalled at both ends in ball bushings 35, 36 and 37, 38, respectively, which are fixedly mounted on the vertical stand portion 22.

The movable plate 32 is connected via an adjusting screw 39 to a disc motor 40, which is controlled via connecting conductors 41 from a processor, e.g. a microprocessor (not shown) in such a way that the vertical position of the circular saw blades is changed automatically in a predetermined manner in dependence on the position of a respective insulating material sheet (i.e. pressboard sheet) on the supporting rollers 23. With a sawing machine, where the shaft for the saw blades is vertically adjustable in the manner described, the profile of the cooling channel elements may be changed arbitrarily for each individual order. In this way it will be relatively simple to obtain the proper shape of a transformer winding with flared end portions.

The specific embodiments of electrical inductive apparatus, method of manufacturing the cooling channel elements and machine for manufacturing the cooling channel elements described above may be modified in many ways within the scope of the following claims.

What is claimed is:

1. An electrical inductive apparatus comprising:

a core of magnetic material with at least one leg and several yokes connected thereto;

at least one winding wound on said core and comprising a plurality of superimposed turns of sheet-formed electrically-conducting material;

at least one cooling channel element, defining with a surface of at least one of said turns of said winding a plurality of channels for conducting an insulating fluid, in contact with a part of said surface from one to the other end face of the winding, said cooling channel element comprising a plurality of elongated spacing means disposed in substantially parallel spaced relationship in contact with said surface, and connecting means joining adjacent spacing means together, each said connecting means being spaced from the said surface to define with the latter and the two spacing means it connects at least some of said plurality of channels; and wherein each of said elongated spacing means has a thickness, transverse to the direction of connection of the connected together spacing means, increasing from a central region of the spacing means towards each of its opposite ends.

2. An electrical inductive apparatus according to claim 1, wherein said at least one cooling channel element is disposed between the confronting surfaces of two adjacent turns of the winding, with a first face of each of said spacing means in contact with one of said confronting surfaces and a second face of each of said spacing means, and spaced apart from said first face, in contact with the other of said confronting surfaces.

3. An electrical inductive apparatus according to claim 2, wherein said connecting means of said at least one cooling element are joined to adjacent pairs of spacing means to provide some of said channels between said connecting means and said one confronting face and others of said channels between said connecting means and the other of said other confronting face.

4. An electrical inductive apparatus according to claim 1, wherein said at least one cooling channel element comprises a flexible sheet of insulating material in which grooves are provided from both sides, the material remaining at the sides of the grooves constituting said elongated spacing means and the material remaining at the bottom of the grooves constituting said connecting means.

* * * * *